US010827583B2

(12) United States Patent
Wang et al.

(10) Patent No.: US 10,827,583 B2
(45) Date of Patent: Nov. 3, 2020

(54) LED DRIVER WITH SILICON CONTROLLED DIMMER, APPARATUS AND CONTROL METHOD THEREOF

(71) Applicant: Silergy Semiconductor Technology (Hangzhou) LTD, Hangzhou (CN)

(72) Inventors: Longqi Wang, Hangzhou (CN); Jianxin Wang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 16/356,013

(22) Filed: Mar. 18, 2019

(65) Prior Publication Data

US 2019/0327802 A1 Oct. 24, 2019

(30) Foreign Application Priority Data

Apr. 18, 2018 (CN) ..... 2018 1 0349102

(51) Int. Cl.
*H05B 45/37* (2020.01)
*H05B 45/10* (2020.01)
*H05B 45/50* (2020.01)

(52) U.S. Cl.
CPC ..... *H05B 45/37* (2020.01); *H05B 45/10* (2020.01); *H05B 45/50* (2020.01)

(58) Field of Classification Search
CPC .. H05B 33/0815; H05B 37/02; H05B 39/044; H05B 33/0845; H05B 39/047; H05B 33/083; H05B 41/28; H05B 41/2827; H05B 33/0824; H05B 33/0887; H05B 45/37; H05B 45/10; H05B 45/50; H05B 45/3575; H05B 45/00; Y10S 315/04
See application file for complete search history.

(56) References Cited

U.S. PATENT DOCUMENTS

| | | | | |
|---|---|---|---|---|
| 8,614,551 | B2 | 12/2013 | Chen et al. | |
| 9,125,270 | B2 | 9/2015 | Liao et al. | |
| 9,578,706 | B1 | 2/2017 | Lai et al. | |
| 2014/0062322 | A1 | 3/2014 | Yu et al. | |
| 2014/0159616 | A1* | 6/2014 | Wang | H05B 33/0848 315/307 |
| 2016/0150607 | A1* | 5/2016 | Kim | H05B 33/0815 315/210 |
| 2017/0208660 | A1* | 7/2017 | Hilgers | H05B 33/0845 |
| 2017/0223794 | A1* | 8/2017 | Lewis | H02M 1/081 |
| 2018/0115234 | A1* | 4/2018 | Liu | H02M 1/00 |

* cited by examiner

*Primary Examiner* — Renan Luque
(74) *Attorney, Agent, or Firm* — Michael C. Stephens, Jr.

(57) ABSTRACT

An apparatus for an LED driver with a silicon-controlled dimmer, can include: a bleeder circuit coupled to a DC bus of the LED driver, and being configured to draw a bleeder current from the DC bus; and a controller configured to adjust the bleeder current to decrease in accordance with a first current sampling signal that represents a drive current flowing through an LED load after the silicon-controlled dimmer transitions from an off state to an on state. A method of controlling an LED driver can include: drawing a bleeder current from a DC bus of the LED driver; and controlling the bleeder current in accordance with a first current sampling signal representing a drive current flowing through an LED load to decrease after the silicon-controlled dimmer transitions from an off state to an on state.

20 Claims, 5 Drawing Sheets

LED DRIVER WITH SILICON CONTROLLED DIMMER, APPARATUS AND CONTROL METHOD THEREOF

RELATED APPLICATIONS

This application claims the benefit of Chinese Patent Application No. 201810349102.2, filed on Apr. 18, 2018, which is incorporated herein by reference in its entirety.

FIELD OF THE INVENTION

The present invention generally relates to the field of power electronics, and more particularly to an LED driver with a silicon-controlled dimmer, and associated circuits and methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Figure 1:
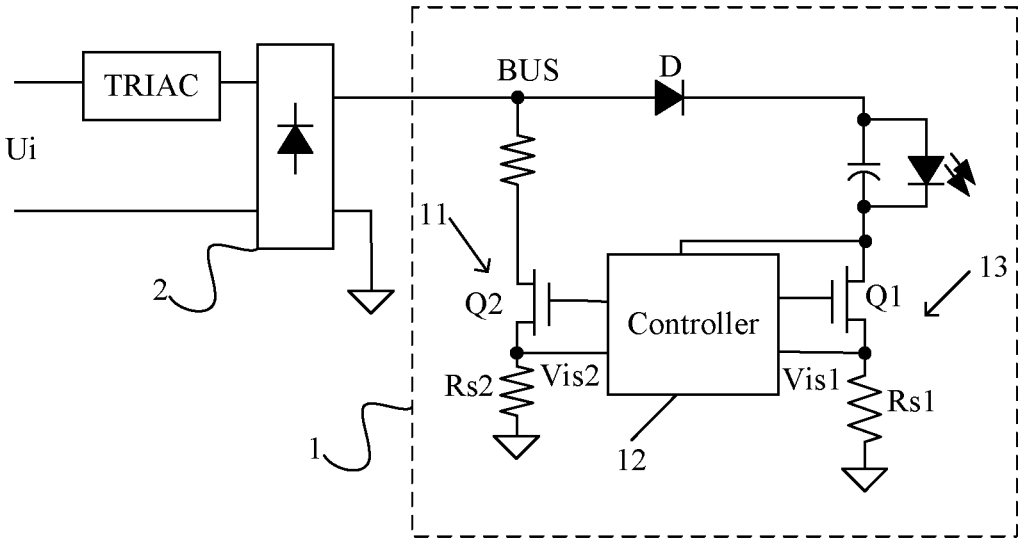
FIG. 1 is a schematic block diagram of an example LED driver, in accordance with embodiments of the present invention.

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

A silicon-controlled dimmer is commonly used for dimming in light-emitting diode (LED) drivers. By utilizing phase control to achieve dimming, the silicon-controlled dimmer can be turned on during each half cycle of the sine wave, in order to obtain the same conduction angle. The conduction angle can be regulated by an adjustment chopper phase of the silicon-controlled dimmer in order to achieve dimming. A TRIAC of a silicon-controlled dimmer may be a switching device. Latching current is the minimum current required to maintain the TRIAC in an on state immediately after the TRIAC transitions from an off state to the on state when given a triggering signal. Also, the holding current is the minimum current required to maintain the TRIAC in the on state. The holding current is generally related to the junction temperature, and the latching current can be 2-4 times larger than the holding current. Therefore, a relatively large conduction current may be required when the silicon-controlled dimmer is turned on, which can result in increased power consumption of an LED driver with the silicon-controlled dimmer, as well as decreased system efficiency.

In one embodiment, an apparatus for an LED driver with a silicon-controlled dimmer, can include: (i) a bleeder circuit coupled to a DC bus of the LED driver, and being configured to draw a bleeder current from the DC bus; and (ii) a controller configured to adjust the bleeder current to decrease in accordance with a first current sampling signal that represents a drive current flowing through an LED load after the silicon-controlled dimmer transitions from an off state to an on state. In one embodiment, a method of controlling an LED driver with a silicon-controlled dimmer, can include: (i) drawing a bleeder current from a DC bus of the LED driver; and (ii) controlling the bleeder current in accordance with a first current sampling signal representing a drive current flowing through an LED load to decrease after the silicon-controlled dimmer transitions from an off state to an on state.

Referring now to FIG. 1, shown is a schematic block diagram of an example LED driver, in accordance with embodiments of the present invention. This example LED driver can include silicon-controlled dimmer TRIAC, apparatus 1, and rectifier circuit 2. Silicon-controlled dimmer TRIAC can connect between an AC input port and rectifier circuit 2 for chopping an alternating current (AC) signal. Rectifier circuit 2 can rectify the chopped signal and output the direct current signal to a DC bus to drive an LED load. Apparatus 1 can include bleeder circuit 11, controller 12, linear adjustment circuit 13, and diode D. in some cases, diode D can be removed from the circuit.

Bleeder circuit 11 can include transistor Q2 and detector Rs2. Current sampling signal Vis2 can characterize a bleeder current is generated by detector Rs2, in order to control the bleeder current flowing through transistor Q2. Linear adjustment circuit 13 can include transistor Q1 and detector Rs1. Current sampling signal Vis1 can characterize a drive current flowing through the LED load, and may be generated by detector Rs1 to adjust a control voltage of transistor Q2. In this example, the LED load can connect in series with linear adjustment circuit 13. In some cases, the LED load can be arranged separately from the linear devices in the linear adjustment circuit. Detectors Rs1 and Rs2 may be resistors or other devices that can be used to sample current.

Bleeder circuit 11 can connect to the DC bus, and may be controlled to draw the bleeder current when silicon-controlled dimmer TRIAC is turned on. Linear adjustment circuit 13 can connect between the cathode of the LED load and ground, in order to adjust the drive current of the LED load. The conduction time of silicon-controlled dimmer TRIAC can be detected by a detector element. For example, the detector element can detect a sudden change of the DC bus voltage, in order to determine the conduction time of silicon-controlled dimmer.

Controller 12 may adjust the control voltage of linear adjustment circuit 13 after silicon-controlled dimmer TRIAC transitions from the off state to the on state, in order to increase the drive current flowing through the LED load and simultaneously decrease the control voltage of the bleeder circuit, thereby decreasing the bleeder current. In this way, current sampling signal Vis1 can increase as the drive current increases, in order to adjust the control voltage of transistor Q2 to decrease the bleeder current. To maintain the conduction of silicon-controlled dimmer TRIAC, the increased value of the drive current flowing through the LED load can be approximately equal to the decreased value of the bleeder current. When the drive current increases to a larger value, the increased value of the drive current is larger than the decreased value of the bleeder current.

Controller 12 may control the drive current to increase after silicon-controlled dimmer TRIAC is turned on relative to a desired drive current corresponding to a predetermined output reference value, and control the bleeder current to decrease relative to a desired bleeder current corresponding to a predetermined bleeder reference value. The predetermined output reference value may correspond to a desired drive current when the LED load is stably operating. The predetermined bleeder reference value may correspond to a desired bleeder current for maintaining the dimmer in the on state. For example, controller 12 can adjust the drive current of the LED load according to a parameter characterizing the DC bus voltage, and to adjust the bleeder current according to current sample signal Vis1. Further, controller 12 may adjust the drive current of the LED load by superimposing the parameter on a compensation signal. The compensation signal can characterize an error between a reference voltage (e.g., REF) and current sample signal Vis1 that characterizes the drive current of the LED load.

In particular embodiments, controller 12 can be in a first state when the silicon-controlled dimmer is turned on, in order to adjust the drive current of the LED load by the compensation signal. Controller 12 can transition to a second state after a predetermined time, in order to maintain the drive current of the LED load corresponding to the predetermined output reference value by superimposing the parameter characterizing the bus voltage on the compensation signal. In this way, after silicon-controlled dimmer TRIAC transitions from the off state to the on state, the drive current can be controlled to increase, and the bleeder current controlled to decrease accordingly, thereby reducing the power consumption caused by the current when silicon-controlled dimmer TRIAC is turned on, and improving the efficiency of the LED driver.

Figure 2:
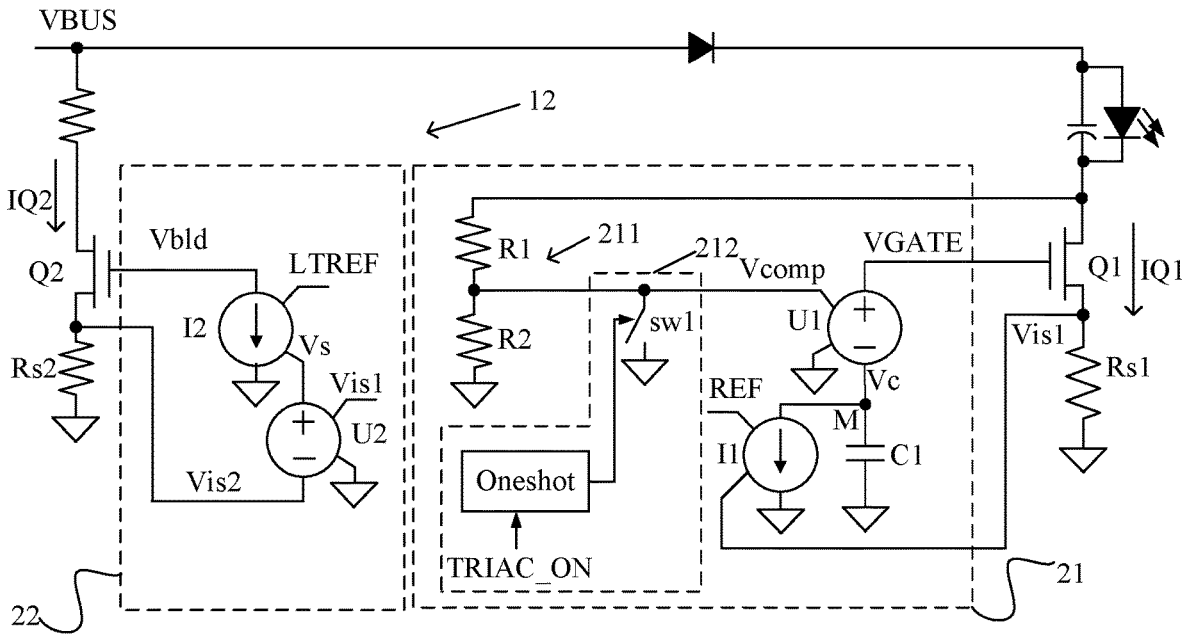
FIG. 2 is a schematic block diagram of an example apparatus for an LED driver with a silicon-controlled dimmer, in accordance with embodiments of the present invention.

Referring now to FIG. 2, shown is a schematic block diagram of an example apparatus for an LED driver with a silicon-controlled dimmer, in accordance with embodiments of the present invention. In this particular example, controller 12 can include control circuits 21 and 22. Control circuit 21 can adjust control voltage VGATE of the linear adjustment circuit to increase drive current IQ1 of the LED load after silicon-controlled dimmer TRIAC is turned on. Control circuit 22 may adjust control voltage Vbld of the bleeder circuit to decrease bleeder current IQ2 after silicon-controlled dimmer TRIAC is turned on. In this example, after silicon-controlled dimmer TRIAC is turned on, control circuit 21 can increase drive current IQ1 of the LED load with respect to the predetermined output reference value. Control circuit 22 may control bleeder current IQ2 to decrease with respect to the predetermined bleeder reference value. The predetermined output reference value may correspond to the desired drive current when the LED load is stably operating. The predetermined bleeder reference value may correspond to the desired bleeder current for maintaining the dimmer in the on state.

In another example, after silicon-controlled dimmer TRIAC transitions from the off state to the on state, controller 12 can adjust the drive current of the LED load based on the parameter characterizing DC bus voltage VBUS and the compensation signal, and adjust the bleeder current based on current sample signal Vis1. For example, control circuit 21 can generate control voltage VGATE of the linear adjustment circuit by superimposing the parameter on the compensation signal. In another example, after silicon-controlled dimmer TRIAC is turned on, controller 12 can adjust the drive current of the LED load based on the compensation signal within a predetermined time. After silicon-controlled dimmer TRIAC is on for the predetermined time, the drive current is adjusted by superimposing the compensation signal on the parameter characterizing the DC bus voltage. The compensation signal may represent a difference between reference voltage REF and current sample signal Vis1.

As shown in FIG. 2, control circuit 21 can include voltage dividing circuit 211, delay circuit 212, compensation circuit I1, controlled voltage source U1, and capacitor C1. Voltage dividing circuit 211 can connect between the drain terminal of transistor Q1 and ground, and may collect parameter Vcomp characterizing DC bus voltage VBUS. Delay circuit 212 controlled by conduction signal TRIAC_ON of silicon-controlled dimmer TRIAC can connect to the output terminal of voltage dividing circuit 211, and may adjust the control voltage of the linear adjustment circuit. For example, conduction signal TRIAC_ON can be obtained by detecting a sudden change of the DC bus voltage to characterize the turn-on time of silicon-controlled dimmer TRIAC. Compensation circuit I1 can connect between intermediate terminal M and ground, and may generate compensation signal Vc according to current sample signal Vis1 and reference voltage REF. Capacitor C1 can connect between intermediate terminal M and ground for generating compensation signal Vc.

Controlled voltage source U1 can connect between the gate of transistor Q1 and intermediate terminal M. Controlled voltage source U1 may have a negative control terminal for receiving parameter Vcomp, and a positive control terminal connected to ground, in order to provide control voltage VGATE for controlling the linear adjustment circuit. Control voltage VGATE can be equal to the difference between compensation signal Vc and parameter Vcomp, such that control voltage VGATE of the linear adjustment circuit is opposite to the change of DC bus voltage VBUS after silicon-controlled dimmer TRIAC is on for a predetermined time. Thus, drive current IQ1 flowing through transistor Q1 can be controlled to decrease as DC bus voltage VBUS increases, thereby reducing the power consumption of transistor Q1 and improving the efficiency of the system.

It should be understood that controlled voltage source U1 may directly superimpose inverted parameter Vcomp on compensation signal Vc, or may superimpose the value proportional to inverted parameter Vcomp on compensation signal Vc. Therefore, after silicon-controlled dimmer TRIAC transitions from the off state to the on state, controlled voltage source U1 can generate control voltage VGATE (e.g., the control voltage of transistor Q1) of the linear adjustment circuit according to compensation signal Vc. After the silicon-controlled dimmer is turned on for the predetermined time, controlled voltage source U1 can generate control voltage VGATE by superimposing compensation signal Vc on parameter Vcomp. Reference voltage REF may characterize a predetermined output reference value.

In another example, delay circuit 212 may be directly connected to the drain terminal of transistor Q1, thereby omitting voltage dividing circuit 211. In addition, the voltage dividing circuit can connect to the DC bus, or the delay circuit can be directly connected to the DC bus, in order to collect the parameter characterizing DC bus voltage VBUS. In another example, delay circuit 212 may be omitted, and control voltage VGATE of the linear adjustment circuit can be generated based on parameter Vcomp and compensation signal Vc after silicon-controlled dimmer TRIAC transitions from the off state to the on state.

Control circuit 22 can include bleeder control circuit I2 and controlled voltage source U2. Controlled voltage source U2 can generate controlled voltage Vs according to current sample signals Vis1 and Vis2. Current sample signal Vis1 may indicate drive current IQ1 of the LED load, and current sample signal Vis2 may indicate bleeder current IQ2. Bleeder control circuit I2 can generate control voltage Vbld for the bleeder circuit (e.g., the control voltage of transistor Q2) based on controlled voltage Vs and reference voltage LTREF. Reference voltage LTREF may indicate a predetermined bleeder reference value. In this example, both compensation circuit I1 and bleeder control circuit I2 can be achieved by a follower. It should be understood that other circuit structures (e.g., differential amplifiers, etc.) capable of achieving the above functions can additionally or alternatively be included in certain embodiments.

In addition, delay circuit 212 can include single triggered circuit Oneshot and control switch sw1. Whether silicon-controlled dimmer TRIAC is turned on can be detected by the detection circuit, and the detection circuit can generate conduction signal TRIAC_ON of silicon-controlled dimmer TRIAC. For example, the detection circuit can determine whether silicon-controlled dimmer TRIAC is turned on by detecting a sudden change of the DC bus voltage. When conduction signal TRIAC_ON of silicon-controlled dimmer TRIAC is active, single triggered circuit Oneshot may generate a pulse having a preset time width in response to conduction signal TRIAC_ON, such that control switch sw1 is turned off for the preset time after silicon-controlled dimmer TRIAC is turned on for the predetermined time.

In particular embodiments, controlled voltage source U1 can generate control voltage VGATE of transistor Q1 according to compensation signal Vc in the first state, and can generate control voltage VGATE of transistor Q1 according to parameter Vcomp characterizing DC bus voltage VBUS and compensation signal Vc in the second state. Therefore, control voltage VGATE of transistor Q1 is at a first threshold in the first state, such that drive current IQ1 of the LED load is relatively large after silicon-controlled dimmer TRIAC transitions from the off state to the on state, thereby causing bleeder current IQ2 to decrease. After silicon controlled TRIAC is turned on for the predetermined time, controller 12 can be in the second state. In this state, control switch sw1 may be turned off, and the control voltage of transistor Q1 is VGATE=−Vcomp+Vc, such that the change tendency of control voltage VGATE is opposite to the change tendency of DC bus voltage VBUS. Also, the drive current of the LED load may be maintained as substantially constant at the desired current corresponding to the output reference value.

Since the control voltage of transistor Q1 is maintained at the larger first threshold in the first state, drive current IQ1 flowing through transistor Q1 (e.g., the drive current of the LED load) can be relatively larger with respect to the output reference value after silicon controlled TRIAC transitions from the off state to the on state, thereby increasing current sample signal Vis1. Since controlled voltage Vs=Vis1+Vis2, controlled voltage Vs can increase as current sample signal Vis1 increases. For example, control voltage Vbld of transistor Q2 is G*(LTREF-Vs), and G is a gain of bleeder control circuit I2. As controlled voltage Vs increases, Control voltage Vbld of transistor Q2 decreases, and bleeder current IQ2 may decrease correspondingly.

When silicon controlled TRIAC is turned on, input current Iin flowing into the DC bus can be equal to the sum of the drive current and the bleeder current, that is Iin=IQ1+IQ2. If drive current IQ1 flowing through transistor Q1 is increased by Is1, the bleeder current flowing through transistor Q2 can correspondingly be decreased by Is1 by applying current sample signal Vis1 to control circuit 22, thereby reducing the power consumption during conduction phase of silicon-controlled dimmer TRIAC. When bleeder current IQ2 is reduced to a relatively small value, drive current IQ1 flowing through the LED load can be increased by a value greater than the value by which bleeder current IQ2 is decreased. The time of entering the off state for control switch sw1 can be delayed for the predetermined time by single triggered circuit Oneshot, such that after silicon controlled TRIAC is turned on for the predetermined time, the change of control voltage VGATE of the linear adjustment circuit is opposite to the change of DC bus voltage VBUS, and drive current IQ1 flowing through transistor Q1 may be maintained as substantially constant at the desired current corresponding to the output reference value.

In this way, after silicon controlled TRIAC transitions from the off state to the on state, the drive current of the LED load can be increased, and the bleeder current of the bleeder circuit correspondingly reduced, thereby reducing the power consumption that may be caused by the current when silicon-controlled dimmer TRIAC is turned on, and improving the efficiency of system.

Figure 3:
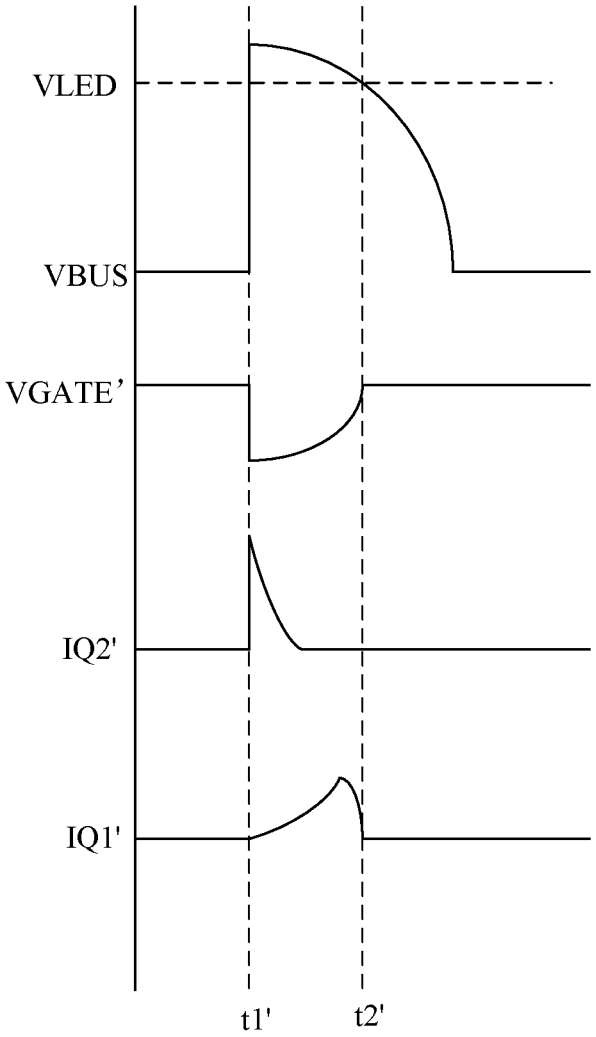
FIG. 3 is a waveform diagram showing example operation of an example LED driver.

Referring now to FIG. 3, shown is a waveform diagram showing example operation of an example LED driver. In this example, at time t1', DC bus voltage VBUS suddenly increases, and silicon-controlled dimmer TRIAC can be turned on. As a comparative operation waveform, after silicon-controlled dimmer TRIAC transitions from the off state to the on state, the change of control voltage VGATE' of the linear adjustment circuit can immediately be opposite to the change of DC bus voltage VBUS. Also, the bleeder circuit may begin to generate a larger bleeder current in order to maintain silicon-controlled dimmer TRIAC in the on state. Bleeder current IQ2' can increase at time t1', and then decrease correspondingly as drive current IQ1' of the LED load increases. As a result, a relatively large current may be required during conduction phase of silicon-controlled dimmer TRIAC. Therefore, although the power consumption of the transistor in the linear adjustment circuit is reduced when silicon-controlled dimmer TRIAC is turned on, the efficiency of LED driver may be relatively low due to the relatively large bleeder current.

Figure 4:
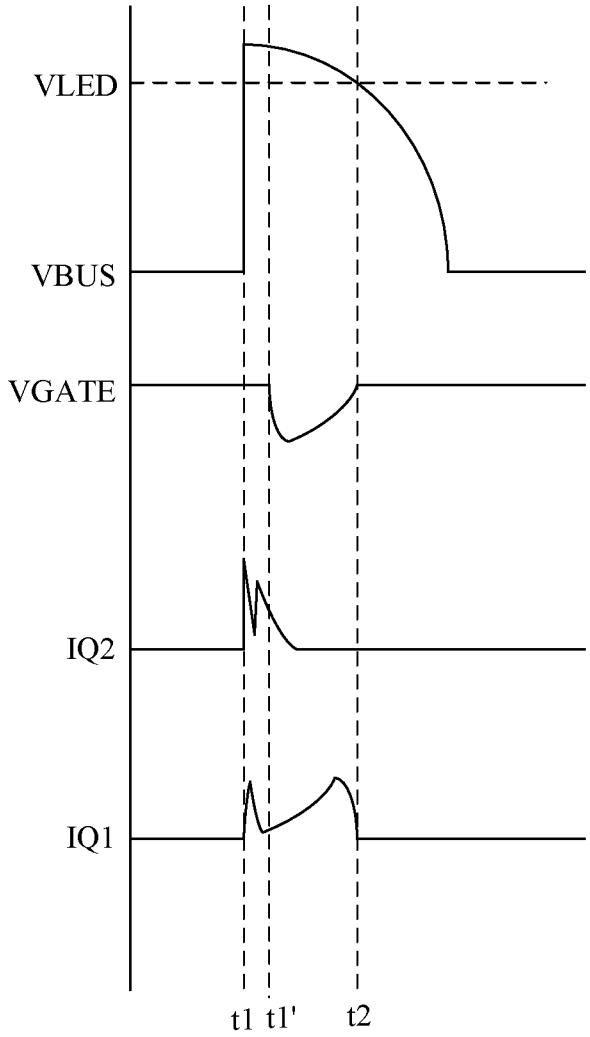
FIG. 4 is a waveform diagram showing example operation of the LED driver, in accordance with embodiments of the present invention.

Referring now to FIG. 4, shown is a waveform diagram showing example operation of the LED driver, in accordance with embodiments of the present invention. In this particular example in the LED driver, when silicon-controlled dimmer TRIAC transitions from the off state to the on state, control voltage VGATE of the linear adjustment circuit may be maintained at the larger first threshold for the predetermined time (e.g., t1−t'), such that drive current IQ1 of transistor Q1 increases with respect to the predetermined output reference value for the predetermined time. By applying the current sample signal characterizing drive current IQ1 of the LED load to control circuit 22, the control voltage of transistor Q2 can be decreased, thereby decreasing bleeder current IQ2 correspondingly.

When silicon-controlled dimmer TRIAC is turned on, input current Iin flowing into the DC bus can be equal to the sum of the drive current and the bleeder current; that is, Iin=IQ1+IQ2. If drive current IQ1 flowing through transistor Q1 is increased by Is1, by applying current sample signal Vis1 to control circuit 22, bleeder current IQ2 flowing through transistor Q2 can correspondingly be decreased by Is1. When bleeder current IQ2 is reduced to a relatively small value, the value of drive current IQ1 flowing through the LED load can be increased by a value greater than the value by which the bleeder current is decreased, such that the power consumption during conduction phase of silicon-controlled dimmer TRIAC is reduced.

During a preset time period (e.g., t'−t2) after the silicon-controlled dimmer TRIAC is turned on for the predetermined time, the change of the control voltage of the linear adjustment circuit can be opposite to the change of the DC bus voltage by superimposing compensation signal Vc on parameter Vcomp characterizing the DC bus voltage, in order to maintain drive current IQ1 of the LED load as substantially constant at the desired current corresponding to the output reference value. Therefore, drive current IQ1 may be decreased when DC bus voltage VBUS is relatively large, in order to decrease the power consumption of the transistor Q1 and improve the efficiency of the system. In this way, after silicon-controlled dimmer TRIAC transitions from the off state to the on state, the drive current of the LED load can be increased and the bleeder current of the bleeder circuit correspondingly reduced, thereby reducing the power consumption caused by the current when silicon-controlled dimmer TRIAC is turned on, and improving the efficiency of system.

Figure 5:
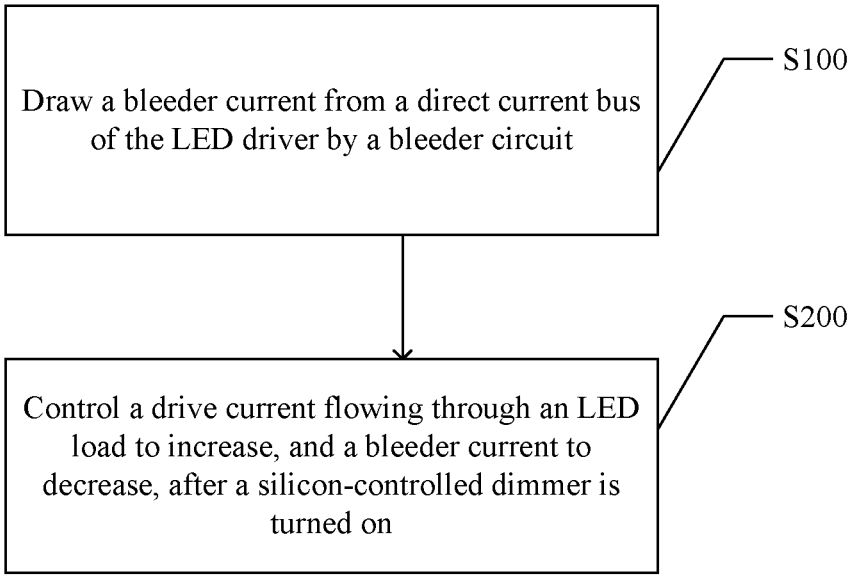
FIG. 5 is a flow diagram of an example control method of the LED driver, in accordance with embodiments of the present invention.

Referring now to FIG. 5, shown is a flow diagram of an example control method of the LED driver, in accordance with embodiments of the present invention. This example control method can be adopted to control an LED driver with a silicon-controlled dimmer. At S100, a bleeder circuit may be controlled to draw a bleeder current from a DC bus when the silicon-controlled dimmer is turned on. At S200, after the silicon-controlled dimmer transitions from an off state to an on state, the drive current flowing through the LED load can accordingly be increased, and a bleeder current decreased. In addition, the increased value of the drive current of the LED load increased is equal to or greater than the decreased value of the bleeder current.

For example, the drive current can be controlled to increase with respect to a predetermined output reference value after the silicon-controlled dimmer is turned on, and the bleeder current may be controlled to decrease with respect to a predetermined bleeder reference value. The predetermined output reference value can correspond to a desired drive current when the LED load stably operates. The predetermined bleeder reference value may correspond to a desired bleeder current that maintains the silicon-controlled dimmer in the on state. Further, the drive current of the LED load can be adjusted by a parameter characterizing the DC bus voltage, and the bleeder current may be adjusted by a current sample signal characterizing the drive current. In addition, after the silicon-controlled dimmer is turned on for the predetermined time, the drive current of the LED load can be adjusted by superposing a compensation signal on the parameter characterizing the DC bus voltage, and the compensation signal may indicate a difference between a reference voltage and the current sample signal characterizing the drive current of the LED load.

In this way, after silicon-controlled dimmer TRIAC transitions from the off state to the on state, the drive current of the LED load can be controlled to increase and the bleeder current of the bleeder circuit correspondingly controlled to decrease, thereby reducing the power consumption caused by the current when silicon-controlled dimmer TRIAC is turned on, and improving the efficiency of system.

Those skilled in the art will recognize that the controller above implemented by analog circuits can additionally or alternatively be implemented by digital circuits in conjunction with digital-to-analog/analog-to-digital conversion (DAC/ADC) devices. For example, the digital circuitry may be implemented by use of one or more specific integrated circuits (ASICs), digital signal processors (DSPs), digital signal processing devices (DSPDs), programmable logic devices (PLDs), field programmable gate arrays (FPGAs), processors, controllers, microcontrollers, microprocessors, and/or any other electronic units for carrying out the functions as described herein. For associated firmware or software implementation, particular embodiments may be implemented with modules (e.g., procedures, functions, etc.) in order to achieve the functions described herein. These software codes can be stored in a non-transitory storage medium/memory, and executed by the processor. The memory may be implemented within the processor, or external to the processor in which case the memory can be communicatively coupled to the processor.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. An apparatus for a light-emitting diode (LED) driver with a silicon-controlled dimmer, the apparatus comprising:

a) a bleeder circuit coupled to a direct current (DC) bus of said LED driver, and being configured to draw a bleeder current from said DC bus; and b) a controller configured to adjust said bleeder current to decrease and a drive current flowing through an LED load to simultaneously increase after said silicon-controlled dimmer transitions from an off state to an on state and when a voltage of said DC bus is greater than a driving voltage of said LED load, wherein said bleeder current begins to decrease while said DC bus voltage is greater than said driving voltage, and wherein a first current sampling signal represents said drive current.

2. The apparatus of claim 1, wherein said controller is configured to control said bleeder current to decrease relative to a desired bleeder current that corresponds to a predetermined bleeder reference value after said silicon-controlled dimmer is turned on.

3. The apparatus of claim 2, wherein:

a) said bleeder current is adjusted in accordance with an error between a first reference voltage and the sum of said first current sampling signal and a second current sampling signal; and b) said first reference voltage corresponds to said predetermined bleeder reference value, and said second current sampling signal represents said bleeder current.

4. The apparatus of claim 1, wherein an increased value of said drive current is not less than a decreased value of said bleeder current.

5. The apparatus of claim 1, wherein said controller is configured to adjust said drive current based on a parameter characterizing said DC bus voltage and a compensation signal, wherein said compensation signal represents an error between said first current sampling signal and a first reference voltage.

6. The apparatus of claim 5, wherein said controller is configured to adjust said drive current based on a compensation signal within a predetermined time after said silicon-controlled dimmer is turned on, and to adjust said drive current by superimposing said parameter on said compensation signal after said predetermined time.

7. The apparatus of claim 1, wherein said bleeder current is controlled to decrease correspondingly when said first current sampling signal is detected to be higher.

8. The apparatus of claim 1, wherein said controller comprises:

a) a first control circuit configured to receive said first current sampling signal and a first reference voltage, and to generate a compensation signal as a control voltage of a linear adjustment circuit that is coupled between said LED load and ground; and b) a second control circuit configured to receive said first current sampling signal, a second current sampling signal representing said bleeder current, and a second reference voltage, and to generate a control voltage of said bleeder circuit.

9. The apparatus of claim 8, wherein said first control circuit is configured to receive a parameter characterizing said DC bus voltage after said silicon-controlled dimmer is on for a predetermined time, and to generate said control voltage of said linear adjustment circuit by superimposing said parameter on said compensation signal.

10. The apparatus of claim 9, wherein said first control circuit comprises:

a) a delay circuit configured to adjust said control voltage of said linear adjustment circuit based on a conduction signal of said silicon-controlled dimmer;

b) a compensation circuit coupled between an intermediate node and ground, and being configured to generate said compensation signal based on said first current sampling signal and said first reference voltage; and c) a first controlled voltage source coupled between said intermediate node and a control node of said linear adjustment circuit, and being configured to adjust said control voltage of said linear adjustment circuit by superimposing said parameter on said compensation signal.

11. The apparatus of claim 10, wherein said delay circuit comprises:

a) a control switch coupled between a control terminal of said first controlled voltage source and a ground terminal; and b) a single triggered circuit configured to control said control switch to be turned on within a predetermined time after said silicon-controlled dimmer is turned on, in order to adjust said control voltage of said linear adjustment circuit by said compensation signal, and to control said control switch to be turned off after said predetermined time, in order to adjust said control voltage of said linear adjustment circuit by superimposing said parameter on said compensation signal.

12. The apparatus of claim 8, wherein said second control circuit comprises:

a) a second controlled voltage source configured to generate a controlled voltage based on said first and second current sampling signals; and b) a bleeder control circuit configured to generate said control voltage of said bleeder circuit based on said controlled voltage and said second reference voltage, wherein said second reference voltage corresponds to a bleeder reference value.

13. An LED driver comprising the apparatus of claim 1, and further comprising an alternating current input source coupled to said silicon-controlled dimmer.

14. A method of controlling a light-emitting diode (LED) driver with a silicon-controlled dimmer, the method comprising:

a) drawing a bleeder current from a direct current (DC) bus of said LED driver; and b) controlling said bleeder current to decrease and a drive current flowing through an LED load to simultaneously increase after said silicon-controlled dimmer transitions from an off state to an on state and when a voltage of said DC bus is greater than a driving voltage of said LED load, wherein said bleeder current begins to decrease while said DC bus voltage is greater than said driving voltage, and wherein a first current sampling signal represents said drive current.

15. The method of claim 14, further comprising controlling said bleeder circuit to decrease relative to a desired bleeder current corresponding to a predetermined bleeder reference value after said silicon-controlled dimmer is turned on.

16. The method of claim 15, further comprising adjusting said bleeder current in accordance with an error between a first reference voltage and the sum of said first current sampling signal and a second current sampling signal, wherein said second current sampling signal represents said bleeder current, and said first reference voltage corresponds to said bleeder reference value.

17. The method of claim 14, wherein an increased value of said drive current is not less than a decreased value of said bleeder current.

18. The method of claim 14, further comprising adjusting said drive current based on a parameter characterizing said DC bus voltage and a compensation signal, wherein said compensation signal represents an error between said first current sampling signal and a first reference voltage.

19. The method of claim 18, further comprising adjusting said drive current according to a compensation signal within a predetermined time after said silicon-controlled dimmer is turned on, wherein said drive current is adjusted by superimposing said parameter on said compensation signal after said predetermined time.

20. The apparatus of claim 1, further comprising:

a) a linear adjustment circuit coupled between said LED load and ground, and being configured to adjust said drive current in response to a control voltage; and b) a delay circuit in said controller, wherein said delay circuit is configured to adjust said control voltage based on a conduction signal of said silicon-controlled dimmer.

* * * * *